United States Patent [19]

Smith

[11] 4,039,137

[45] Aug. 2, 1977

[54] BEND OR BREAK SHELF SUPPORT

[76] Inventor: Edward J. Smith, 11 Bisset Drive, West Milford, N.J. 07480

[21] Appl. No.: 721,155

[22] Filed: Sept. 7, 1976

Related U.S. Application Data

[63] Continuation-in-part of Ser. No. 685,397, May 11, 1976.

[51] Int. Cl.[2] ..... A47F 5/00; E06B 7/28

[52] U.S. Cl. ..... 248/248; 108/106; 211/90

[58] Field of Search ..... 248/300, 248, 247, 235; 52/758 D, 753 Y, 753 D; 108/59, 106; 211/90

[56] References Cited

U.S. PATENT DOCUMENTS

| | | | |
|---|---|---|---|
| 892,542 | 7/1908 | McMaster | 248/248 |
| 994,342 | 6/1911 | Shields | 248/248 |
| 2,190,002 | 2/1940 | Townsend | 52/753 Y X |
| 3,185,416 | 5/1965 | Osinski | 248/527 |
| 3,410,516 | 11/1968 | Criswell | 248/459 |
| 3,696,920 | 10/1972 | Lahay | 248/205 A X |
| 3,817,485 | 6/1974 | Root | 248/300 |

*Primary Examiner*—J. Franklin Foss

*Attorney, Agent, or Firm*—Mel K. Silverman; David A. Jackson

[57] ABSTRACT

The present invention discloses a shelf-support system comprising a plurality of bracket units, each integrally connected by corresponding plurality of crease-breakable, bracket-defining, parallel lines, each of said brackets having a 90° angulation adapted for the support of shelving, cabinets, and other structures having horizontal surfaces.

7 Claims, 5 Drawing Figures

BEND OR BREAK SHELF SUPPORT

REFERENCE TO RELATED APPLICATION

The present application is a continuation-in-part of Ser. No. 685,397, filed May 11, 1976, entitled BEND OR BREAK SHELF SUPPORT.

BACKGROUND OF THE INVENTION

The present invention relates generally to support brackets for shelving. Particularly, the present invention relates to shelving brackets which are applicable to the support of horizontal surfaces which are to be secured within a corner, i.e., at the interface of two or more vertical surfaces.

The prior art, as known by the Applicant, is represented by such patents as U.S. Pat. No. 2,005,484 (1935) to Thorin, and U.S. Pat. No. 3,377,904 (1960) to Olsen.

An illustrated in the above, the prior art in the present field, while disclosing the presence of strips of bracket-like hardware having a plurality of crease-breakable elements, none of the above applies to brackets which are adaptable for purposes of support of horizontal wall systems such as shelving, in closets, cabinets, corners of walls, and the like.

Accordingly, the present invention is directed to means for effectuating the securement of wall systems having one or more horizontal surfaces to be placed in secured abutment to a wall or wall corner.

SUMMARY OF THE INVENTION

The present invention comprises an improved means for shelf support, exhibiting a plurality of brackets, each integrally connected by a corresponding plurality of crease-breakable, bracket-defining parallel lines wherein each of said brackets exhibits a 90° angulation adapted for the support of horizontal surfaces of wall furnishings and, more particularly, adapted for the support of wall furnishings at or within the corner of a room, or within a cabinet enclosure.

Accordingly, it is an object of the present invention to enable a user of the present shelf-support means to efficiently bend a desired length of shelving support in order to appropriately support and secure an interior enclosure upon a wall or within an enclosure or cabinet.

It is a further object to provide a simplified means of installation of all furnishings through a few simple steps including a crease-breaking of bracket strip in order to obtain a desired length and configuration of bracket support.

DETAILED DESCRIPTION OF THE INVENTION

Figure 1:
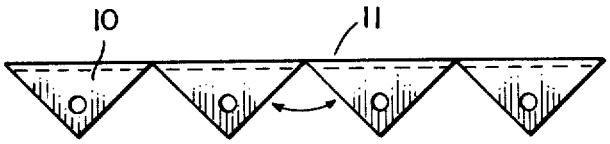
FIG. 1 is a top plan view of the present invention.
Figure 2:
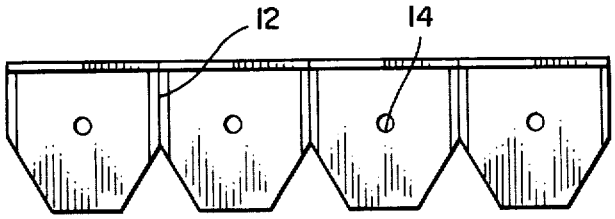
FIG. 2 is a front plan view of the present invention.

It is, in the first instance, to be appreciated that each individual support bracket segment 10 is a part of a single elongated segment system 11 comprising, for example, dozens of individual segments 10. For economy of illustration, only four segments have been illustrated; however, as above noted, it is to be appreciated that the actual system 11 will include, for example, two dozen bracket segments apiece.

The segment system may be formed through any of a number of processes. For example, the elongated length may be pressed, stamped, sheet-rolled, cast, or may be formed by plastic rolling or molding.

It is to be appreciated that each individual segment 10 may be bendably broken at seam 12 in order to attain a variety of different lengths and sizes of bracket combinations. Such a variety of lengths and sizes is required in order to accommodate the various types of shelving and other wall furniture structures or cabinet enclosures for which a securement may be required.

Each segment is provided with at least one support hole 14 in order to provide an appropriate grip against the shelf or cabinet structure. The presence of at least one hole in each bracket unit allows the user to install the invention at any point on a wall without the necessity of searching for individual wall studs or other such structural members. Further, such a frequency of holes, when all are utilized, act to dissipate the overall pressure which otherwise would impinge upon each individual nail, screw or other fastener which is used in conjunction with the holes 14. This feature has proven most beneficial in conjunction with certain soft wall construction materials such as sheetrock.

In addition, it is to be appreciated that a plurality of holes 16 are employed in order to secure the lower surface of the horizontal structure to the present bracket system. The large numbers of holes 16 function to lend greater surface support to the secured shelf or cabinet.

It is to be further noted that the surfaces 17 may be provided with a pressure-activated adhesive in order to enhance its functionality.

Figure 5:
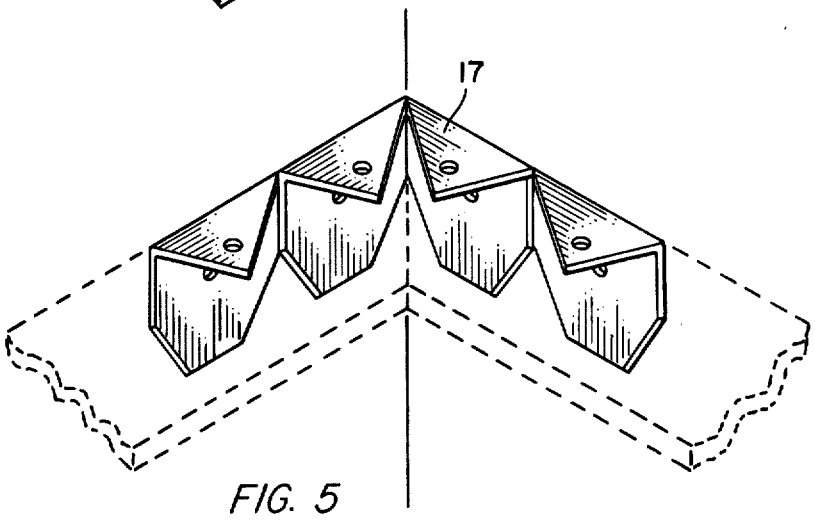
FIG. 5 is a perspective view showing the manner in which a shelf situation within the corner of a room is used with the present invention.

Also, as shown in FIG. 5, it is to be appreciated that the present invention enjoys a particular utility with respect to securement of shelves within cabinets or shelves secured within the corner of a room. This feature derives from the aspect of the present invention which permits a bend to be made along any of the creases 12, as may be desired in order to follow the shape of the wall or corner. Further, said feature permits the use of a continuous length or strip which, inherently, will provide greater strength and lateral support than would exist in the use of individual bracket units.

Per the above, it must be appreciated that one or two bendings or flexings of the present invention will not cause the seam to break apart. Rather, five or six flexes or creasings are required in order to obtain a break. This characteristic can be readily attained through state of the art molding techniques, both in the plastic and metallurgical areas.

Further, the segment system 11 may be formed in a variety of sizes in order to provide a practical variety of size and strength requirements.

Figure 3:
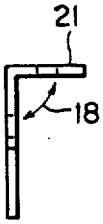
FIG. 3 is a side plan view.
Figure 4:
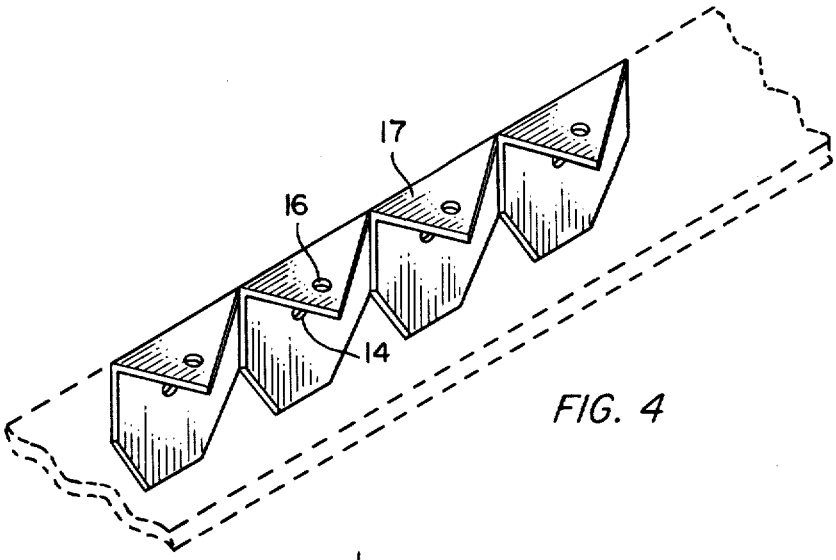
FIG. 4 is a side perspective view of the invention illustrating the manner in which a linear shelf arrangement is supported.

With reference to FIG. 3, it is to be noted that the angle 18 is that of 90° which is the standard angle used in the supporting of shelves.

The thickness 20 would depend on the type of material used and the strength required for a particular application.

It is to be recognized that the superficial design of the segment system can include stylish, ornamental adaptations and, accordingly, need not be necessarily limited to that style or appearance shown in the figures.

As above noted, the seam 12 is of a special importance in the present invention in that the structural strength or weakness of said seam will be dictated by characteristics of the material used as well as the dimensions of the seam per se. The seam 12 may, in addition to molding techniques, be formed through a tack-welding process involving a plurality of tackwelds. Also, a perforated line structure may be used.

Also, a separate material of suitable crease-breakable characteristic may be secured medially between each segment 10.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention what I claim as new, useful and non-obvious and accordingly secure by Letters Patent of the United States is:

1. A shelf-support system of modular construction comprising a plurality of serially connected bracket members, said bracket members comprising substantially planar structures having an L-shaped cross-section, said bracket members further comprising a longer, plate-like vertical support member, said vertical support member integral at the top horizontal edge thereof with a horizontally extending longitudinally extending shelf-support member, said shelf-support member tapered toward its outer end to define a substantially triangular shape, and a flexible, severable connector portion located intermediate said bracket members and integral with the vertical edges of said vertical members whereby each of said brackets is detachably attached in flexible fashion to form a longitudinally extended support structure, and said system is adapted to bend to a 90-degree angle with respect to itself to provide support to a shelf member at the junction of two walls by the flexure of said connector between said segments, and said system is selectively severable to a desired longitudinal extension by the fracture of said connector portion.

2. The shelf-support system of claim 1 wherein said vertical support member and said shelf-support member are each provided with at least one hole therethrough.

3. The shelf-support system of claim 1 wherein said vertical support member and shelf-support member are provided on the outer surfaces thereof with a layer of pressure-sensitive adhesive.

4. The system as recited in claim 1 in which said connector portion comprises a plurality of parallel, linear, reduced-thickness portions each formed of a multiplicity of perforated holes.

5. The system as recited in claim 4 in which said reduced-thickness portions are each formed of a plurality of spot-welds.

6. The system as recited in claim 1 in which said conductor portion comprises a second material of crease-bendable and breakable characteristics medially disposed between each segment.

7. The shelf-support system as recited in claim 1 in which the horizontal outer surfaces of each segment exhibits a layer of pressure adhesive.

* * * * *